US006811523B1

(12) United States Patent
Timmer

(10) Patent No.: US 6,811,523 B1
(45) Date of Patent: Nov. 2, 2004

(54) LOWER EXTREMITY REHABILITATION AND EXERCISE DEVICE

(76) Inventor: Kirk Timmer, 1413 41st St., S., Great Falls, MT (US) 59405

( * ) Notice: Subject to any disclaimer, the term of this patent is extended or adjusted under 35 U.S.C. 154(b) by 51 days.

(21) Appl. No.: 09/893,799

(22) Filed: Jun. 26, 2001

Related U.S. Application Data

(60) Provisional application No. 60/214,025, filed on Jun. 26, 2000.

(51) Int. Cl.[7] ..... A63B 21/00

(52) U.S. Cl. ..... 482/146; 482/147; 482/34; 482/79

(58) Field of Search ..... 472/116, 123, 472/112, 106.15; 482/95, 96, 146, 147, 79, 105, 80, 34

(56) References Cited

U.S. PATENT DOCUMENTS

| | | | | |
|---|---|---|---|---|
| 1,565,484 A | * | 12/1925 | McWhirter | 482/146 |
| 3,895,794 A | * | 7/1975 | England | 482/146 |
| 3,984,100 A | | 10/1976 | Firster | |
| 4,186,920 A | | 2/1980 | Fiore | |
| 4,635,932 A | | 1/1987 | Dewees | |
| 4,653,748 A | | 3/1987 | Seel et al. | |
| 4,739,986 A | | 4/1988 | Kucharik et al. | |
| 5,035,421 A | | 7/1991 | Scheller | |
| 5,112,045 A | | 5/1992 | Mason et al. | |
| 5,368,536 A | | 11/1994 | Stodgell | |
| 5,603,334 A | | 2/1997 | Sharp | |
| 5,722,919 A | | 3/1998 | Timmer | |
| 5,810,703 A | | 9/1998 | Stack | |
| D405,135 S | | 2/1999 | Scott | |
| 5,891,002 A | | 4/1999 | Maki | |
| 5,897,474 A | | 4/1999 | Romero | |

* cited by examiner

*Primary Examiner*—Jerome W. Donnelly
(74) *Attorney, Agent, or Firm*—Saliwanchik, Lloyd & Saliwanchik

(57) ABSTRACT

A lower extremity rehabilitation and exercise device has a platform to which at least one foot is secured. A fulcrum is placed beneath the platform at various locations. Exercises performed by the user involve the platform pivoting about the fulcrum in a manner that requires the use of specific muscles or muscle groups. Various fulcrum locations correspond to particular muscles or muscle groups which are stressed while the exercise is performed. The exercises build strength in the muscle or muscle groups which are stressed during exercise. Proprioception within the stressed muscle or muscle group is also developed during exercise.

3 Claims, 6 Drawing Sheets

LOWER EXTREMITY REHABILITATION AND EXERCISE DEVICE

CROSS-REFERENCE TO RELATED APPLICATIONS

This application claims priority to U.S. Provisional Application Ser. No. 60/214,025, filed Jun. 26, 2000. The disclosures of that application is hereby incorporated by reference in its entirety, including all figures, tables, and drawings.

BACKGROUND OF THE INVENTION

An ankle injury can be devastating. The ankle is a complex joint including an intricate bone structure, muscles and tendons, ligaments and a neurological system. Rehabilitation of an injured ankle can be frustrating when attempting to isolate and selectively retrain the injured area.

The ankle moves in multiple planes. The ankle moves about an axis which passes transversely through the body of the talus bone by dorsi flexion and plantar flexion. Movement about the longitudinal axis of the subtalar joint accomplishes inversion and eversion of the foot. The ankle joint also moves by internal and external rotation.

Rehabilitative devices for the ankle and lower extremities have been described. These devices either strengthen damaged muscle or develop proprioception in the injured area. Open chain devices (U.S. Pat. No. 5,722,919) are non-weight bearing and are used to strengthen an injured area. Closed chain devices, or weight-bearing devices, most often are used to develop proprioception. Proprioception involves neuromuscular receptors in the skeletal muscles and on the surface of the tendons. These receptors provide constant feedback to the brain regarding movement, posture, changes in equilibrium, knowledge of position, weight, and resistance against its body parts. Using this feedback, the brain corrects or adapts to any changes in these circumtstances. Injury to the muscles or tendons of the ankle can damage the receptors affecting proprioception. The most popular device for developing proprioception and retraining the receptors in an injured area is a balance board. A platform rests upon a small centered fulcrum. As the platform rocks upon the fulcrum, the brain sends messages to various muscles of the lower extremities instructing them to correct the instability. In this manner, the brain re-educates or trains damaged receptors of the muscles or tendons. A variation of a balance board that has become the industry standard is described in U.S. Pat. No. 4,653,748. Additional, variations of balance boards are described in the following U.S. Pat. Nos. D405, 135; 3,984,100; 4,635,932; 4,635,932; 5,603,334; 5,810, 703; 5,891,002; and 5,897,474. Other rehabilitative and therapeutic devices for the ankle and lower extremities are described in U.S. Pat. Nos. 4,186,920; 4,739,986; 5,035, 421; 5,112,045; and 5,368,536. Exercise magazines are replete with advertisements for ankle rehabilitative devices. These devices however are limited in that they only strengthen the damaged ankle or develop proprioception in the ankle. Further, these devices do not allow specific targeting of the muscles or tendons that require therapy.

From the foregoing, it is apparent that a need remains for a rehabilitative device for the ankle and lower extremities that can both strengthen an injured area and develop proprioception. This device would be most effective if the injured area could be specifically isolated and targeted for retraining and rehabilitation.

SUMMARY OF THE INVENTION

The device of the subject invention is a rehabilitative and exercise device for the ankle and lower extremities. The device comprises a platform to which the foot of a user is secured. The platform balances upon a self-gripping fulcrum. The user, by employing the muscles of the ankle and lower extremities, brings the platform from an initial position in which the platform rests upon the fulcrum and the floor to a balanced or neutral position in which the platform balances upon the fulcrum and is parallel to the floor.

The fulcrum can be moved freely to any position beneath the platform which allows specific muscles or muscle groups to be isolated and targeted for rehabilitation. Exercises on the device of the subject invention can be performed with an off-set center of gravity because the foot or feet are strapped to the board. This provides variable resistance levels for strengthening damaged or weak muscles.

DETAILED DESCRIPTION OF THE INVENTION

The subject invention involves a lower extremity rehabilitation and exercise device. A platform, to which at least one foot is secured, balances upon a self-gripping fulcrum allowing specific groups of muscles to be strengthened and proprioception to be developed.

Figure 1A:
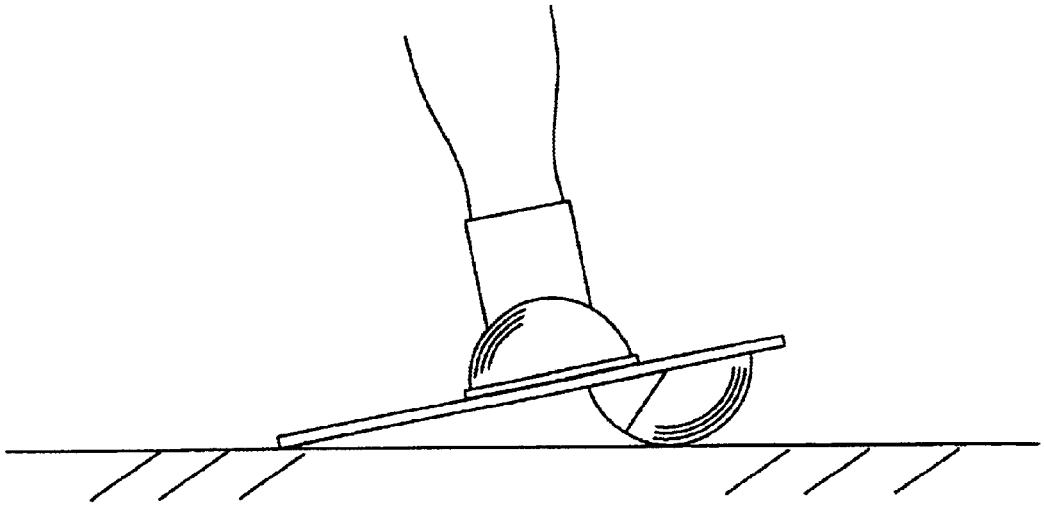
FIG. 1A shows a front elevational view of a preferred embodiment of the device of the subject invention in use.
Figure 1B:
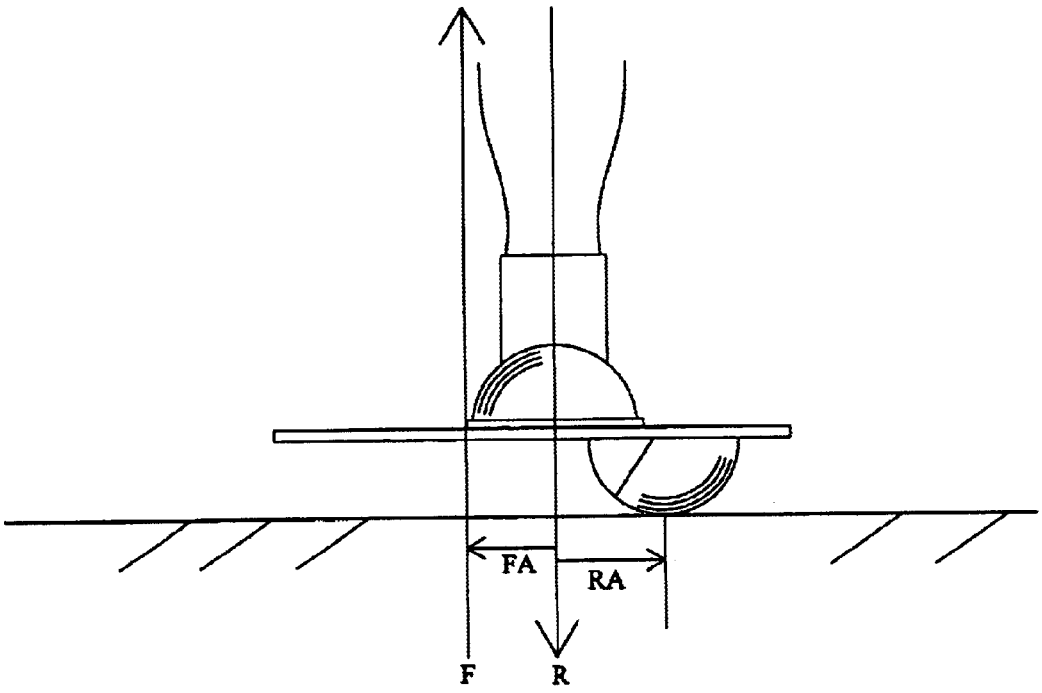
FIG. 1B shows a front elevational view of a preferred embodiment of the device of the subject invention in use.

The device of the subject invention is shown in use in FIGS. 1A and 1B. The subject device allows the user to isolate a muscle group targeting it for strengthening or exercise if, for example, the muscle group has been strained or otherwise injured. A foot of a user is secured to the platform 10. A fulcrum 11 is placed beneath the platform at a specific location with the intent of targeting a specific muscle or muscle group for exercise. In its initial position (FIG. 1A), the platform 10 rests upon the fulcrum 11 and the floor. In performing the exercise, the user must contract the muscle or muscle group opposite the fulcrum to bring the platform to a neutral or balanced position (FIG. 1B). FIG. 1B shows the neutral position of the platform to which the platform is raised during performance of the exercise. In FIG. 1B the user has contracted the targeted muscle to lift the platform to the horizontal or neutral position. Numerous repetitions of the exercise shown in FIGS. 1A and 1B cause the user to develop muscle strength in the targeted muscle. Proprioception can likewise be developed performing this exercise.

The device provides a simple lever arm through which the muscle must move to bring the platform to the neutral or balanced position. Still referring to FIG. 1B, the user's weight and center of gravity are resistance (R). The area between the fulcrum 11 and resistance (R) is the resistance arm (RA). The area between resistance (R) and the applied force (F) is the force arm (FA). Force (F) applied by the muscles of the lower extremity to the force arm (FA) pivot the lever about the fulcrum to bring the platform to the balanced or neutral position. Lengthening the resistance arm by moving the fulcrum further from resistance (R) requires that more force be applied to move the platform. Thus, moving the fulcrum further from the foot increases the difficulty of the exercise because more force is required to move the platform. The fulcrum of the subject invention can be easily moved beneath the platform to increase or decrease the difficulty of the exercises depending upon the rehabilitative needs of the user or trainer.

A platform balances upon the fulcrum. The platform of the subject device is shown generally at 10 in FIG. 2. In a preferred embodiment of the subject invention, the platform is circular in shape and has a bottom surface 13 proximate the floor. Further, this embodiment has indicia or markings printed on the platform which can include, but are not limited to, numbers, letters, words, lines, symbols and pictures. The indicia provide direction as to placement of the fulcrum beneath the platform.

The platform can be constructed of a number of materials. Suitable materials for the platform include, but are not limited to, wood, plastic or metal. In a preferred embodiment, the platform is made from a ¾ inch transparent acrylic. Acrylic are strong enough to withstand the weight of a person yet allows printed indicia placed on the platform to be viewed from either side of the platform. Alternatively, indicia can be printed on both sides of an opaque platform.

Figure 2A:
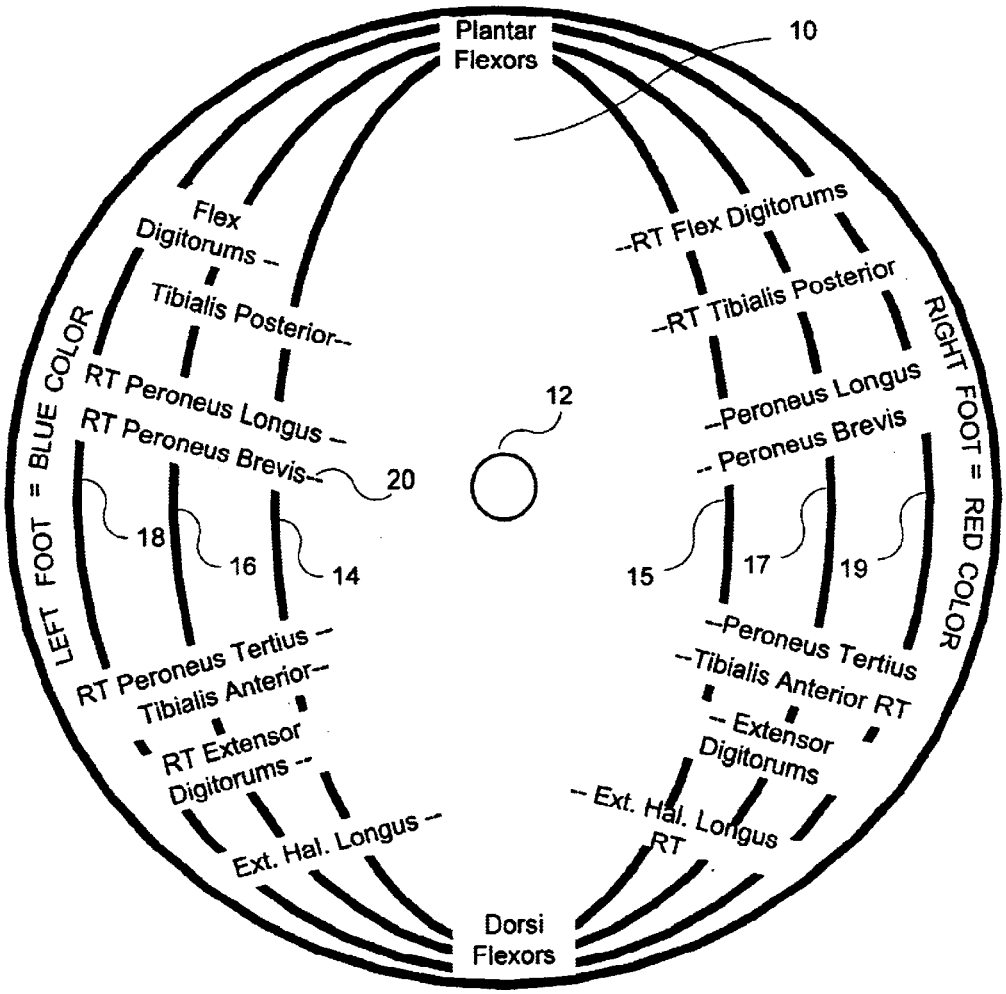
FIG. 2A shows a top plan view of a preferred embodiment of the platform of the device of the subject invention.
Figure 2B:
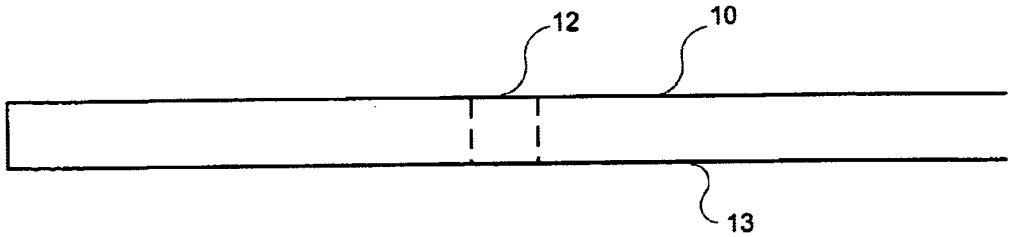
FIG. 2B shows a side view of a preferred embodiment of the platform of the device of the subject invention.

On the platform shown in FIG. 2, lines printed on the platform intersect at specific locations. These intersections correspond to positions where the user can place the fulcrum to exercise a specific muscle or muscle group. Preferably, the subject platform also includes additional indicia at the intersection locations indicating the actual muscle names which are exercised when the fulcrum is placed at that intersection location specifying the muscle or muscle group to be treated and the degree of difficulty of the exercise. The indicia are also printed on the platform in such a way as to assist the user in fulcrum placement should the user desire to exercise the right or left leg. Accordingly, for a specific muscle group, there are indicia printed on the platform to indicate the proper fulcrum location for the muscles of both the right and left leg.

Figure 3:
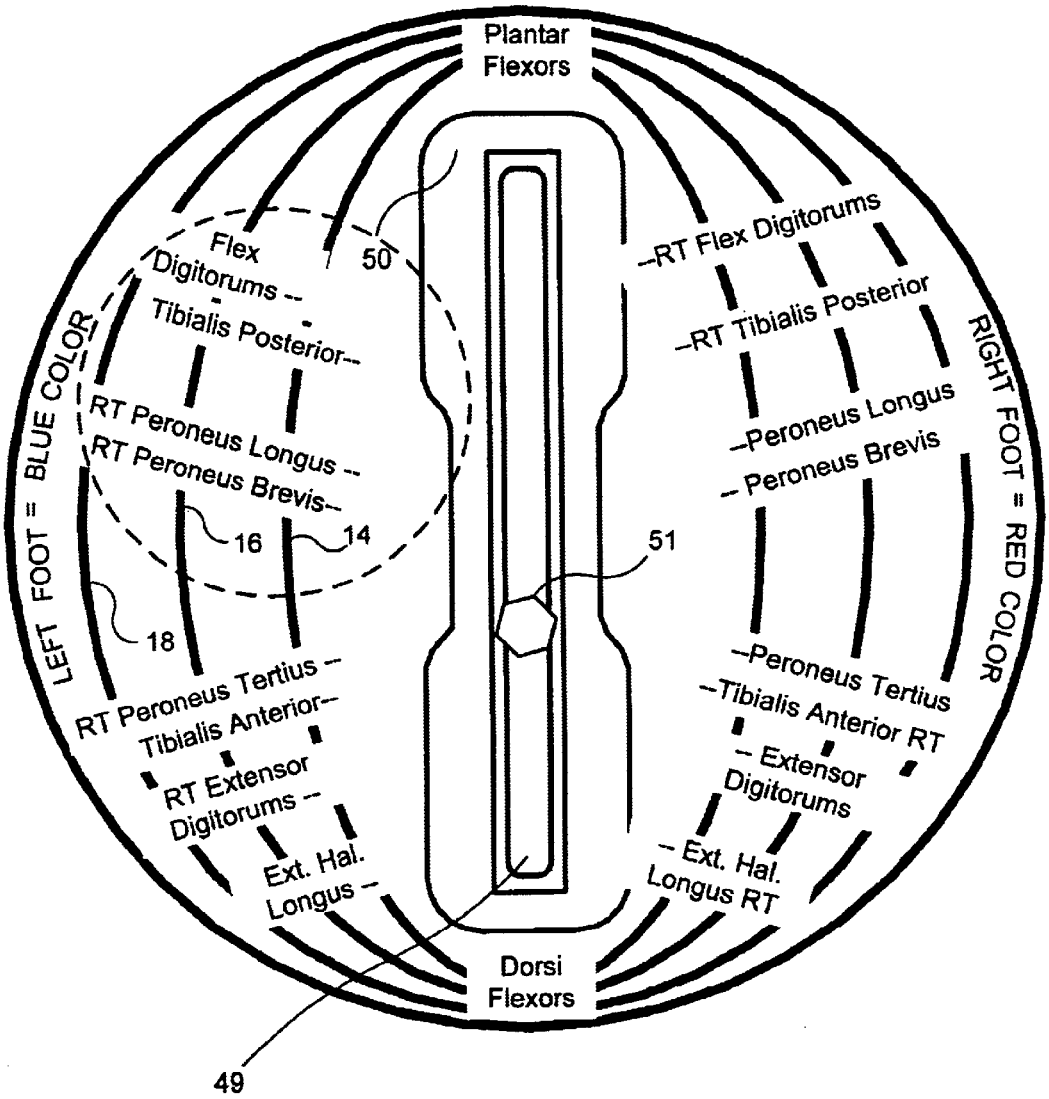
FIG. 3 shows a top plan view of a foot plate attached to a platform of a preferred embodiment of the device of the subject invention.

In an exemplified embodiment, the platform 10 includes a set of lines which provide a visual tool to quantitatively measure the location of the fulcrum. The indicia on the platform can include inner lines 14 and 15 closest to the foot, and lines 16 and 17 intermediate outermost lines 18 and 19. Muscle names are printed on the platform and intersect these lines. For example, the indicia "PERONEUS BREVIS" 20 is printed on the upper portion of the left side of the platform shown in FIG. 2. The indicia "PERONEUS BREVIS" 20 is printed on an angle along an imaginary line which passes through the three lines 14, 16, and 18 on the left side of the platform. The peroneus brevis muscle extends the foot allowing one to point the toe. The fulcrum 11 placed anywhere along the imaginary line on which "PERONEUS BREVIS" is printed require the user to contract that muscle in order to bring the platform to the neutral or balanced position. As noted above, resistance increases as the resistance arm RA is lengthened and the fulcrum is moved further from the foot. Thus, when the fulcrum is placed along the imaginary line further away from the foot, the difficulty of the exercise increases. For example, placement of the fulcrum 11 where the angled imaginary line intersects line 14 as shown in FIG. 3, provides a user the easiest mean by which to exercise the peroneus brevis muscle of the right lower leg with the subject device. Placement of the fulcrum where the angled imaginary line intersects the outermost line 18 provides a user the most difficult means by which to exercise the peroneus brevis muscle of the right lower leg using the subject device. Placement of the fulcrum where the "PERONEUS BREVIS" intersects the intermediate line 16 corresponds to exercises that are of a difficulty between the easiest and the most difficult exercise. The ability of the user to increase the difficulty of the exercise by increasing the distance of the fulcrum from the foot greatly enhances the usability of the device. It is noted however that lines 14, 16 and 18 act only as a visual measuring tool. The fulcrum can be placed anywhere along the imaginary line on which "PERONEUS BREVIS" is printed to exercise that muscle. Additionally, the letters "RT" can be printed along side the indicia "PERONEUS BREVIS" to correspond to placement of the fulcrum when exercising the right foot. In a particularly preferred embodiment however this designation is replaced by a color coding system where the indicia are printed in two colors, one color for the right foot, for example, red, and one color for the left foot; for example, blue.

The exercise performed by the placement of the fulcrum as shown in FIG. 3, is but one of the many exercises which can be performed using the present invention. The most likely used fulcrum locations are shown on the platform in FIGS. 2 and 3. Any location under the board is however a possible fulcrum location. Thus, the fulcrum can be placed beneath the platform to target not only the musculature of the ankle but the musculature of the hip and knee, as well. Additionally, the ability to vary the location of the fulcrum allows the user to target or isolate individual muscles or a combination of muscle groups for strengthening and/or proprioception. Indicia on the platform allow the user to place the platform on the fulcrum and immediately commence the exercise. There is no need for a physical therapist to be present to ensure that the desired muscle group is being exercised.

Typically, a single foot of the user is secured to the platform. A variety of means can be used to secure the foot to the platform. A strap or straps attached directly to the platform can be used to secure the foot. The straps can be elasticized, tied, or contain connectors like buckles, or a conventional hook and loop system, such as VELCRO. Further, the foot can be secured to the platform by clips, clamps or a boot or boot portions integrally formed from the platform. In a preferred embodiment, the platform includes a foot plate 50 (FIG. 3), which is secured to the platform. The foot plate can be made of wood, metal or plastic and can have a profile that resembles the sole of a shoe having a narrower mid-portion and a wider heel and toe portion. The foot plate 50 can be attached to the platform 10 with a simple bolt 51 threaded through an aperture 12 in the platform 10 and an aperture or slot 49 in the foot plate 50. Alternatively, the foot plate could be glued, welded or nailed to the platform or be molded as an integral piece of the platform.

The slot 49 in the foot plate 50 of the exemplified embodiment, allows the platform to be customized for the placement of very small or very large feet on the device.

Figure 4:
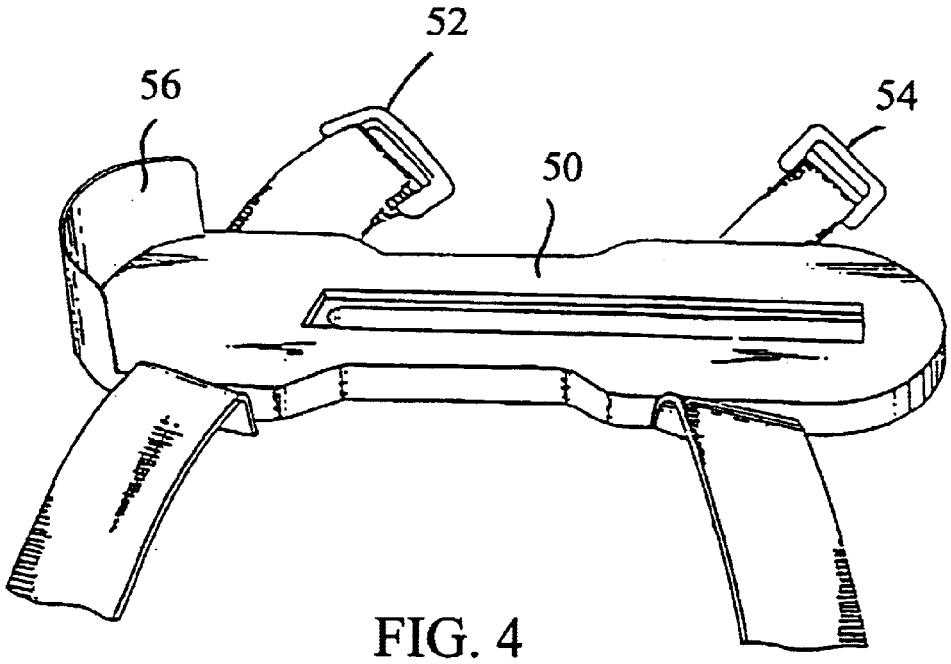
FIG. 4 shows a perspective view of the foot plate of a preferred embodiment of the device of the subject invention.
Figure 5:
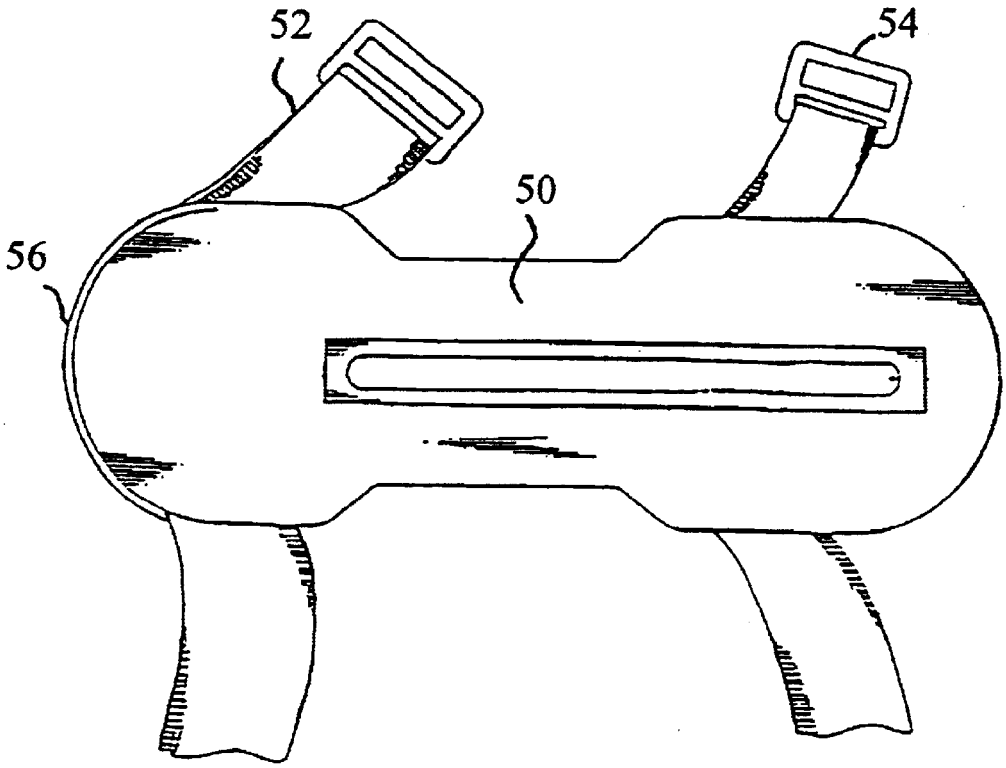
FIG. 5 shows a top plan view of the foot plate of a preferred embodiment of the device of the subject invention.

In a preferred embodiment, shown in FIGS. 4 and 5, the foot plate 50 includes an ankle strap 52, a forefoot strap 54, and a heel stop 56. Each provides means by which to obtain the proper positioning of the foot on the foot plate. The two straps are secured above the foot and secure the foot to the foot plate which is attached to the platform. Accordingly, in this embodiment, the straps 52 and 54 secure the foot to the platform. The foot can likewise be secured to the foot plate with clasps, clips or other types of attachments. The heel stop 56 eases the positioning of the foot in the foot plate.

Figure 6:
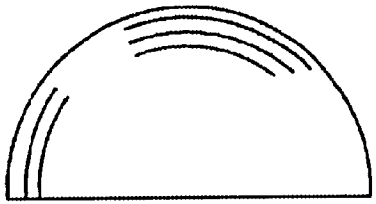
FIG. 6 shows a side elevational view of the fulcrum of a preferred embodiment of the device of the subject invention.
Figure 7:
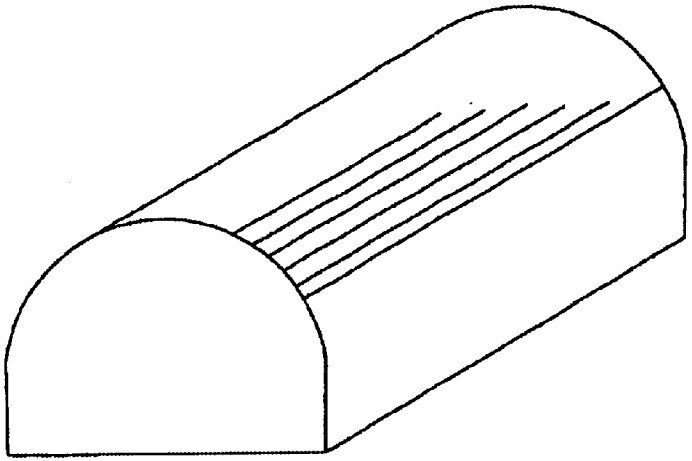
FIG. 7 shows a perspective view of fulcrum of a preferred embodiment of the device of the subject invention.

The fulcrum 11 placed beneath the platform 10 can be a variety of shapes. A preferred fulcrum having a hemispherical shape is shown in FIG. 6. An alternative fulcrum shape is shown in FIG. 7. The fulcrum of FIG. 7 is an elongated block that includes a rounded top surface opposite a flat surface. For either of the described fulcrum shapes, the fulcrum is placed between the platform and the floor at a specific location under the platform. An air disc or air pillow can likewise be used as the fulcrum. The air disc is an air filled bladder which is approximately 14 inches in diameter and about 2½ inches thick.

The fulcrums 11 of the device of the subject invention are preferably self-gripping. This allows the fulcrum to be easily placed at any position beneath the platform and allows the position of the fulcrum to be moved or adjusted without having to remove the foot from the platform and engage complicated or cumbersome fasteners. Repeated removal and adjustment of the device from an injured foot could exacerbate the injury. Further, a self-gripping fulcrum allows the user or trainer to place the fulcrum at any position beneath the platform providing a better ability to target specific muscle groups.

Figure 8:
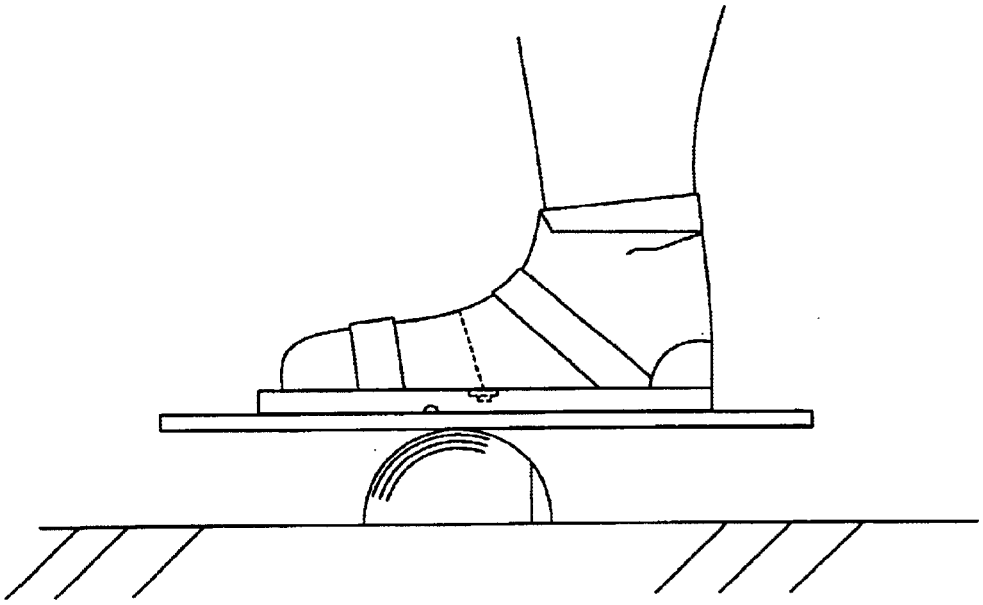
FIG. 8 shows a side elevational view of a preferred embodiment of the device of the subject invention in use.
Figure 9:
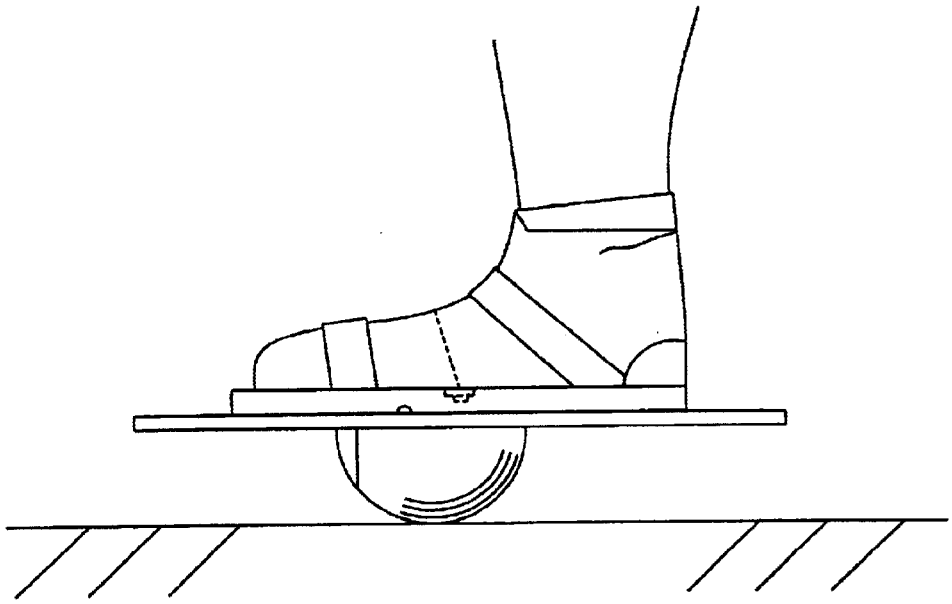
FIG. 9 shows a side elevational view of another preferred embodiment of the device of the subject invention in use.

The self-gripping fulcrum can be made of any material that has sufficient structure to handle the mass of the user and the device and properties which allow it to removably adhere to the platform. The fulcrum must not slide from beneath the platform. For example, a roughened stone fulcrum may be appropriate for use with a wooden platform. Fulcrums that have rubber-like qualities adhere to the bottom of an acrylic platform. These fulcrums can include those of solid rubber, wood coated in a rubberized material such as polyethylene, or composite materials of various plastics or organic materials. A closed foam rubber fulcrum covered in vinyl adheres to a plastic platform. Alternatively, embodiments in which the fulcrum is attachable to the platform are contemplated. For example, a fulcrum could be reversibly attached to the platform using a conventional hook and loop system, such as VELCRO, or a detachable adhesive, such as rubber cement. Further, other mechanical apparatuses that allow the fulcrum to be positioned anywhere beneath the platform can be used on the subject invention. For example, a mechanical swing arm to which the fulcrum is attached would allow the fulcrum to move freely beneath the platform. As shown in FIGS. 8 and 9, fulcrums can be used in several positions. For example, in FIG. 8, the rounded surface of the fulcrum 11 contacts the platform 10. Whereas, in FIG. 9, the rounded surface of the fulcrum contacts the floor.

The straps and/or footplate or the exemplified embodiment require that the heel and toe of the user contact the platform during use of the device. Securing the foot to the platform allows the user to perform exercises while their center of gravity is offset in relation to the fulcrum. The offset center of gravity acts as the resistance (R) that the muscle (F) must overcome to perform the exercise (see FIG. 1B). The distance of the fulcrum from the foot acts as a lever arm through which the muscle must move the center of gravity to perform the exercise. As the lever arm increases the resistance also increases. Typically, the user performs the exercise without changing the location of their center of gravity. However, the exercise can be performed while the user moves their body's center of gravity closer to the fulcrum to decrease the difficulty in performing the exercise.

The foot of the user which is not secured to the platform can be placed in any comfortable, stable position. This foot can be elevated on a non-pivoting platform so that it is at the same height as the foot secured to the platform. Typically, the subject device is used while standing, it is possible however to use the device while seated.

The lower extremity rehabilitation and exercise device of the present invention is distinguishable from typical balance boards in that the present device develops strength and proprioception within a muscle or muscle group as opposed to balance boards which mainly develop proprioception. The present invention can be used as a traditional balance board by placing both feet on the board and balancing the board on the fulcrum. The fulcrum can be placed at various strategic locations during use of the device in this manner. The feet of the user would typically not be strapped to the platform while using the device as a simple balance board. When however one or both feet are strapped to the platform. Balancing exercises can be performed with an off-set fulcrum increasing the resistance and thus the difficulty of the exercise.

It is understood that the foregoing examples and embodiments are merely illustrative of the present invention. Certain modifications of the article of manufacture and/or methods employed may be made and still achieve the objectives of the invention. Such modifications are contemplated as within the scope of the claimed invention.

What is claimed is:

1. An exercise device comprising: a platform greater than the size of the footprint of a foot having a bottom surface; means for securing at least one foot to the platform, wherein the means for securing at least one foot to the platform comprises a foot plate attached to the platform and at least one strap to secure a foot to the foot plate; and a fulcrum capable of contacting and holding the bottom surface of the platform, wherein the fulcrum can contact the platform anywhere along the bottom surface of the platform to provide a static fulcrum about which the platform pivots.

2. An exercise device comprising: a transparent acrylic platform greater than the size of the footprint of a foot having a bottom surface; means for securing at least one foot to the platform; a rubber-like fulcrum adhesively contacting and holding the bottom of the platform; and indicia on said platform to direct placement of said fulcrum on said bottom surface of said platform, wherein the fulcrum can contact the platform anywhere along the bottom surface of the platform.

3. An exercise device comprising: a transparent, acrylic platform greater than the size of the footprint of a foot having a bottom surface; means for securing at least one foot to the platform; and a rubber-like fulcrum adhesively contacting and holding the bottom of the platform, wherein the fulcrum can contact the platform anywhere along the bottom surface of the platform to provide a static fulcrum about which the platform pivots.

* * * * *